United States Patent [19]

Forshee

[11] Patent Number: 4,788,996

[45] Date of Patent: Dec. 6, 1988

[54] FOLDABLE GOLF BAG UMBRELLA-LIKE COVER

[76] Inventor: David J. Forshee, 19138 Faith, Sterling Heights, Mich. 48077

[21] Appl. No.: 126,713

[22] Filed: Nov. 30, 1987

[51] Int. Cl.[4] ..... A45B 3/00; A63B 55/00; A47G 25/12

[52] U.S. Cl. ..... 135/16; 135/25 R; 135/33 C; 206/315.4

[58] Field of Search ..... 135/16, 20 R, 25 R, 135/33 C; 206/315.4

[56] References Cited

U.S. PATENT DOCUMENTS

| | | | |
|---|---|---|---|
| 1,885,968 | 11/1932 | Wedemann | 135/33 C |
| 3,534,752 | 10/1970 | Vanzini | 135/20 R |
| 3,709,238 | 1/1973 | Leopoldi et al. | 135/20 R |
| 3,844,301 | 10/1974 | Harrell | 135/20 R |
| 4,522,300 | 6/1985 | Hamblet | 135/16 X |
| 4,699,164 | 10/1987 | Pilney et al. | 135/16 |

*Primary Examiner*—J. Karl Bell

*Attorney, Agent, or Firm*—Cullen, Sloman, Cantor, Grauer, Scott and Rutherford

[57] ABSTRACT

A foldable umbrella-like cover for covering the open top of a golf club bag and golf clubs extending out of the bag, includes a vertically elongated tube that is centrally positioned within the bag, along with the golf clubs, and is releasably clamped to the wall of the bag. A vertically slidable, elongated rod extends into the tube. A ring-like collar is attached to the lower end of the rod, and the upper end of the rod is provided with a manual grip for sliding the rod into and out of the tube. A number of umbrella ribs are connected, at their inner ends, to the collar so that such inner ends may be moved, with the collar, for retracting the ribs into the tube, for closing the umbrella, or alternatively, extending the ribs outwardly of the tube for opening the umbrella. A flexible cloth-like umbrella cover is secured to the ribs and moves into and out of the tube with the ribs. The ribs are formed of curved plastic strips which resiliently flatten when moved into the tube, but resiliently return to their curved shape when extended outwardly of the tube. The rod slidably extends through a central opening in a disk-like cover plate which is fixedly located a short distance above the upper end of the tube to provide an annular slot between the tube end and the plate. The ribs, along with the umbrella cover, are guided radially outwardly and upwardly through the annular slot for initially extending the umbrella upwardly and outwardly when the rod is pulled upwardly and then are reversely bent into a downwardly extending position over the clubs when the rod is further pulled upwardly. The ribs are retracted when the rod is pushed downwardly for closing the umbrella.

13 Claims, 2 Drawing Sheets

FOLDABLE GOLF BAG UMBRELLA-LIKE COVER

BACKGROUND OF INVENTION

This invention relates to a foldable umbrella-like cover for the open top of a conventional golf club bag.

Conventional golf club carrying bags are generally cylindrical in shape with an open upper end and a closed bottom. Golf clubs are arranged within the bag with the clubs inverted so that their heads extend out of the open end of the bag. Typically, these bags have carrying slings or straps and outer compartments for golf balls, etc. Such bags are commonly moved upon a golf course upon wheeled carriers or golf carts or they may be carried upon the shoulder of a golfer or a caddy. However they are carried, their open upper ends are exposed to the weather.

Because the heads of the golf clubs extend upwardly and radially outwardly of the bags, it is difficult to cover the open tops of these bags when it rains. In the event of a sudden heavy rain, a cloth-like hood, cover or umbrella may be placed over the golf club bag, and the covered bag may be carried to a shelter. An example of such a golf bag umbrella-like cover is disclosed in U.S. Pat. No. 4,522,300 to Hamblet, issued June 11, 1985. However, in the event of a drizzle or of a light rain, during which the golf game may continue, a cloth cover of an umbrella is not feasible, since the golfer must have access to the bag to replace and remove clubs. Consequently, leaving the bag open for any substantial length of time permits water to enter the open upper top of the bag and wet the exposed heads of the golf clubs. Thus, there has been a need for some relatively inexpensive and effective means for covering the open top of the bag and the golf club heads during inclement weather, but which cover can be rapidly or momentarily removed and replaced so that the golfer can quickly insert or remove a club.

Many golfers carry a full-sized umbrella along with their golf bags or upon their golf carts for use when it rains. However, the typical large-size golf umbrellas ordinarily cannot be positioned closely enough above the open top of the bag to provide access to the clubs and to simultaneously protect the heads of the clubs and the bag. Ordinarily, such umbrellas are used to protect the golfer rather than the bag. Thus, ordinary umbrellas have not been satisfactory for covering golf bags when the golf game continues during a light rain or drizzle.

The invention herein concerns a collapsible umbrella-like cover for a golf bag, which cover is carried within the bag, along with the clubs, for immediate use when needed, but which may be easily and quickly collapsed and reopened for access to the clubs in the bag. This umbrella is an improvement upon the general type of umbrella which is described in U.S. Pat. No. 3,844,301 to Harrell, issued Oct. 29, 1974, and U.S. Pat. No. 3,706,160 to Deibert, issued Dec. 19, 1972.

SUMMARY OF INVENTION

This invention relates to a foldable, umbrella-like golf club carrying bag cover which essentially comprises an elongated tube that is arranged within the bag and which carries a small folded umbrella-like cover that may be pulled outwardly of the tube to cover the open top of the bag or pushed into the tube when not needed. The elongated tube is provided with a clamp for releasably securing the tube upon the upper edge of the bag.

The umbrella-like cover portion comprises a series of curved, resiliently flexible ribs which have inner ends connected to a ring-like collar and free outer ends. The ribs are interconnected by a cloth-like umbrella covering. The ring-like collar is slidably fitted within the tube and is connected to the lower end of an elongated rod that extends upwardly out of the open end of the tube. Thus, endwise movement of the rod raises or lowers the collar.

When the collar is lowered into the tube, the umbrella is collapsed by drawing it downwardly into the tube so that its ribs are flattened by the wall of the tube. However, when the collar is moved upwardly, by raising the rod, the umbrella ribs and covering extend upwardly and radially outwardly of the upper end of the tube until the umbrella is withdrawn from the tube. Further, upward movement of the rod and collar causes the umbrella to snap downwardly and reverse itself into a radially outwardly and downwardly position, so that it covers the open upper end of the golf bag and the golf club heads. The covering envelops the upper ends of the clubs which extend out of the open top of the bag. A slight downward movement of the rod will move the collar downwardly a short distance and snap the umbrella back into an upwardly extending, i.e. non-covering, position for removing or inserting a golf club. Return movement of the rod upwardly will again reverse the umbrella, i.e. radially downwardly, to recover the club and bag.

The endwise movement of the rod is guided by an inner guide tube which extends axially within the outer tube and which surrounds the rod. This guide tube is provided with an elongated slot through which a key or connector fits to connect the collar to the rod so that the rod and collar move together. The upper end of the guide tube carries a disk-like guide plate which is located a short distance above the open upper edge or rim of the outer tube to provide an annular slot between the lower surface of the plate and the tube rim. The umbrella ribs and cover extend through the slot. The lower surface of the plate, which may be dished or tapered radially inwardly and upwardly for guiding the umbrella ribs moving through the annular slot, causes the upwardly extending ribs to reverse, i.e. bend downwardly, when the collar presses the inner ends of the ribs against the plate.

An object of this invention is to provide an inexpensive, sturdy, umbrella-like cover for the open upper end of a golf club carrying bag and for the clubs contained within the bag, which cover may be rapidly and easily opened or collapsed over the tops of the clubs without contacting or moving the clubs. The cover is compact and easily stowable within a golf bag where it may be clamped for use when needed.

A further object of this invention is to provide an umbrella-like cover for a golf bag which may be easily operated by simply pulling a rod upwardly, to open the umbrella cover, or pushing it downwardly to collapse the cover. Hence, the golfer may quickly cover the bag when necessary and may momentarily uncover the bag for removal or replacement of clubs with minimal exposure to moisture.

Yet another object of this invention is to provide a golf bag cover, formed like an umbrella, which may be used with virtually any kind of golf club carrying bag regardless of the bag's size or construction.

These and other objects and advantages will become apparent upon reading the following description, of which the attached drawings form a part.

DETAILED DESCRIPTION

Figure 1:
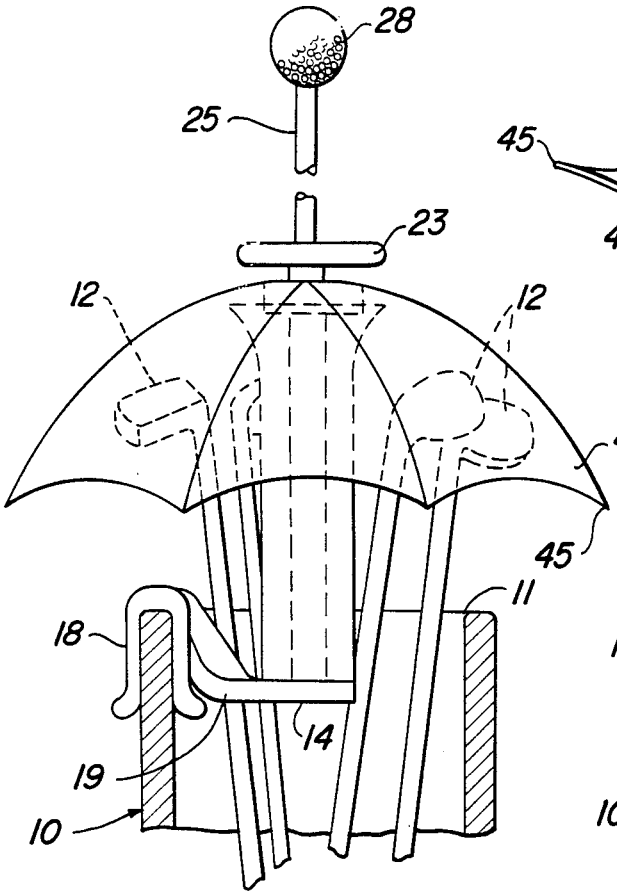
FIG. 1 illustrates the open golf bag umbrella-like cover mounted upon the upper end of the golf bag, which is schematically shown.
Figure 2:
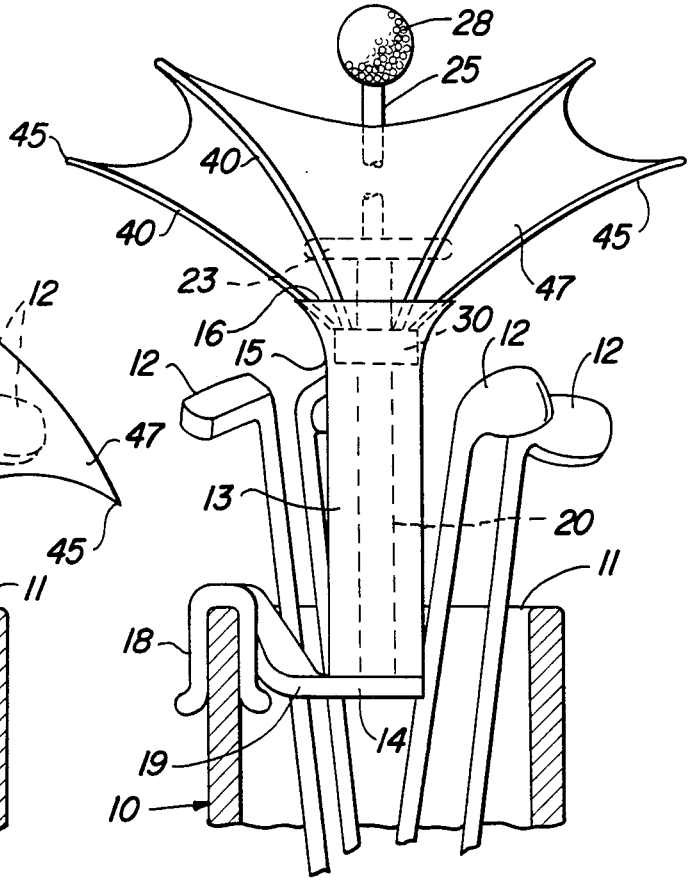
FIG. 2 is a view, similar to FIG. 1, with the umbrella-like cover extended upwardly in its pre-covering position.

FIGS. 1 and 2 schematically illustrate the upper end of a conventional golf club bag 10 having an open top 11. A number of golf clubs 12, which are schematically shown, are located within the bag and extend upwardly a distance above the open top of the bag.

The golf bag umbrella-like cover of this invention comprises a tubular container or outer tube 13 which is arranged within the open upper end of the bag 10. Preferably, the tube is held in coaxial alignment with the bag. The outer tube has a closure or bottom part 14 (see FIG. 6), and its open upper end 15 is flared outwardly. Thus, the upper edge of the tube provides an upper rim 16 which is of a larger diameter than the remainder of the tube.

Figure 9:
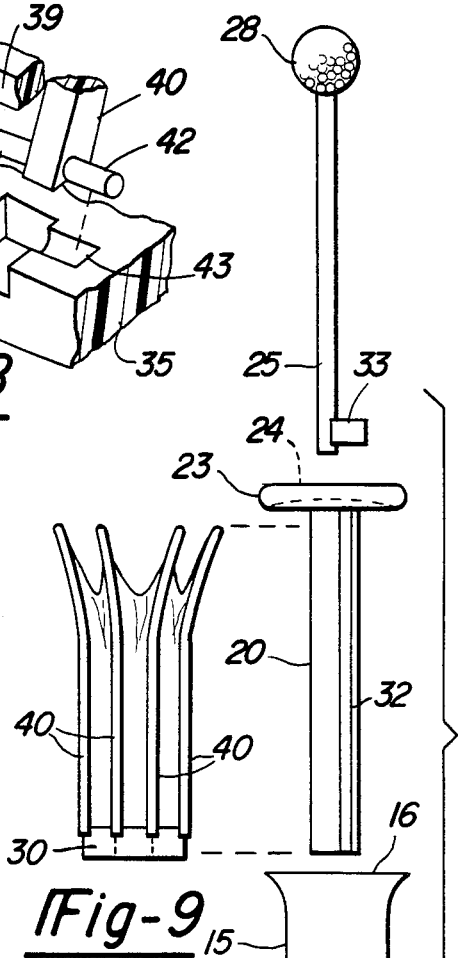
FIG. 9 is a view, to a smaller scale, showing the major parts in disassembled condition.
Figure 7:
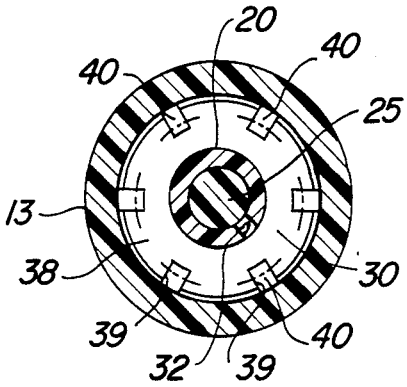
FIG. 7 is a cross-sectional view taken in the direction of arrows 7—7 of FIG. 6.

The tube is removably mounted upon the upper end of the golf bag by a suitable clamp. By way of example, the drawings (see FIG. 9) illustrate a pair of inverted, U-shaped, resilient clamps 18 which are connected to each other by a bracket 19 that is also connected to the tube bottom part 14.

Figure 6:
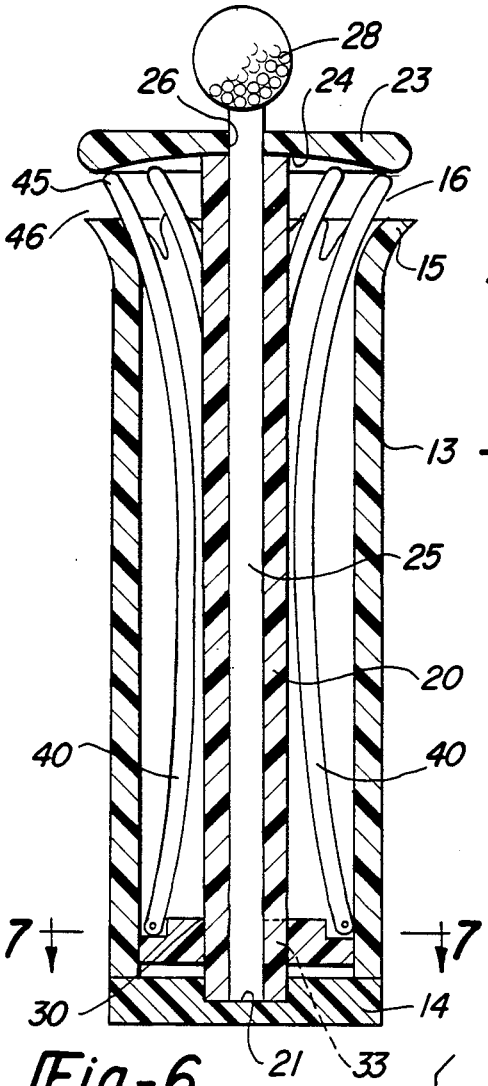
FIG. 6 is an enlarged, cross-sectional, elevational view of the umbrella-like cover shown in its retracted or non-use condition.

As illustrated in FIG. 6, an elongated, inner guide tube 20 is arranged coaxially with the outer tube and extends substantially the full length of the outer tube. The lower end of the guide tube 20 is fixed within a recess 21 formed in the bottom piece 14. The upper end of the guide tube is rigidly connected to a disk-like plate 23 which overlaps the rim 16 of the open top. Preferably, the lower surface 24 of the plate 23 is tapered upwardly and inwardly to form a radially sloping guide surface.

An elongated rod 25 is arranged coaxially within the outer tube 13 and inner guide tube 20 and slidably extends through a central hole 26 formed in the plate 23. The rod may be slid upwardly or downwardly through the plate. For that purpose, a hand grip 28 is provided in its upper end. Although the shape of the grip may vary considerably, an example of such a grip, which is illustrated in the drawings, is of the same approximate size and shape as a golf ball.

A ring-like collar 30 surrounds and is slideably movable upon the inner guide tube 20. The collar is attached to the lower end of the rod so that it moves upwardly and downwardly with the rod 25. Thus, a connection is provided between the collar and the rod through a vertical slot 32 (see FIG. 9) formed along the length of the guide tube 20. A connecting key 33 extends through the slot 32 for rigidly connecting the collar to the rod.

Figure 10:
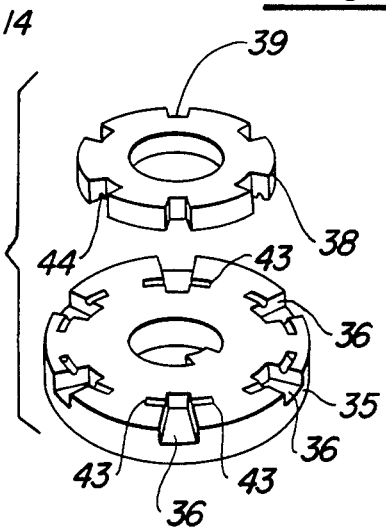
FIG. 10 is a perspective view illustrating the two parts of the slidable collar.

The collar may be formed in a number of ways. By way of example, as illustrated in FIG. 10, the collar is formed of a lower, base disk 35 having a number of equally spaced apart edge slots 36. A smaller diameter cover disk 38 is fastened upon the base disk 35 by suitable mechanical fasteners, such as screws or the like. The cover disk is also provided with edge slots 39 which overlap the slots 36 in the base disk.

Figure 8:
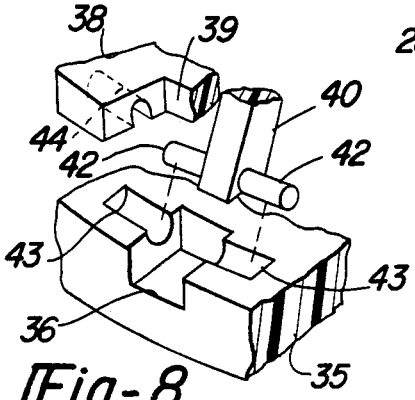
FIG. 8 is a schematic, enlarged view of the pivot connection between a rib and the collar.

An umbrella rib 40 is arranged in each of the aligned slots 36–39. The lower end of each rib is provided with studs 42 which fit into aligned grooves 43 and 44 formed at the edges of the aligned slots (see FIG. 8) so that the rib may pivot relative to the collar. The outer or free ends 45 of the ribs 40 pass through the annular opening or slot 46 which is formed between the outer tube rim 16 and the tapered lower surface 24 of the plate 23.

A cloth-like umbrella cover 47 is connected to the ribs to form a small or miniature umbrella. The cloth-like material may be stitched or otherwise fastened to the ribs so that it collapses or stretches open with the ribs.

The ribs 40 are made of strips of plastic material which are normally curved. The particular plastic selected is characterized by being resilient and having an elastic memory. That is, when the ribs are pulled into the outer tube, as illustrated in FIG. 6, they are flattened by the pressure exerted by the outer surface of the guide tube and the inner surface of the outer tube. However, when the ribs are free of pressure, that is, when they extend outwardly of the outer tube, they return to their normal curved shape to form the umbrella shape illustrated in FIG. 1. A number of commercially available plastics may be used for this purpose, depending upon availability, cost, etc. The selection of the particular plastic may be accomplished by one skilled in the art.

Preferably the entire unit is formed of plastic material. Thus, most of the parts can be molded out of suitable, commercially available plastic materials. The plastic material should be of a type which is relatively inert, that is, which will not be affected by the elements.

Figure 3:
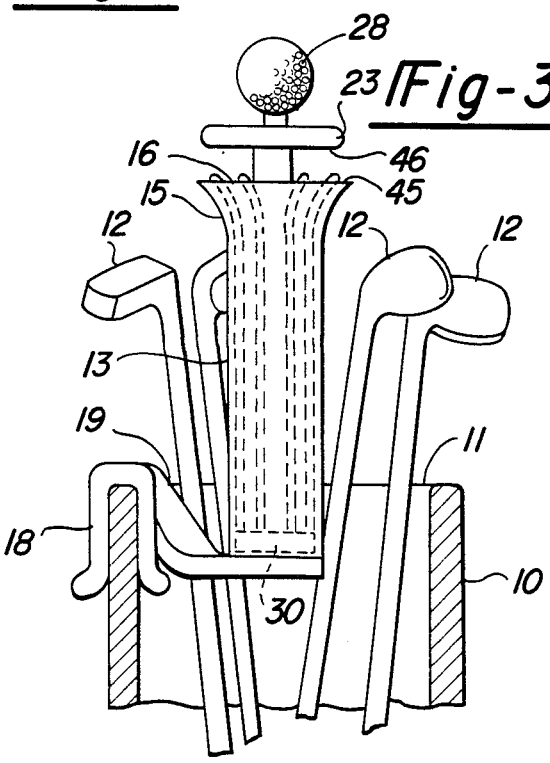
FIG. 3 is a view, similar to FIG. 1, with the umbrella-like cover retracted within its tubular container.

In operation, the user of the device arranges the outer tube within the open upper end of his golf club bag. The clamps 18 are frictionally connected to the upper end portion of the golf bag. Preferably, the tube is centered in the bag and helps separate the clubs. With the tube in position, there is ample room for the golf clubs to extend into the bag with the club heads arranged a considerable distance above the open top of the bag 11 as is usual. FIG. 3 illustrates the non-use or collapsed position of the unit.

Figure 4:
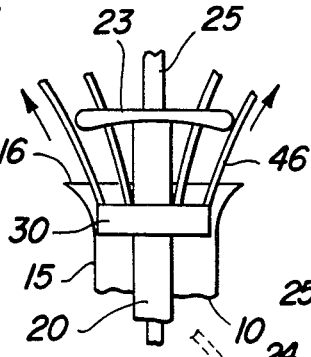
FIG. 4 is a fragmentary, schematic view showing the umbrella ribs extended outwardly and upwardly between the tubular container and the guide plate.

When precipitation is encountered, the golfer merely grasps the grip 28 and pulls the rod 25 upwardly. The upward movement of the rod moves the collar 30 which slides upwardly upon the inner guide tube 20. The upward motion of the collar raises the ribs 40 so that the outer, free ends 45 of the ribs pass through the annular slot 46 located between the disk-like plate 23 and the upper rim 16 of the tube. The flare of the tube upper end helps to guide the ribs in a radially outwardly and upwardly curved direction as shown by the arrows in FIG. 4. At this point, the ribs and cover extend upwardly and outwardly, as illustrated in FIGS. 2 and 4.

Figure 5:
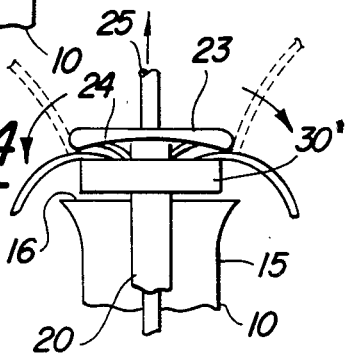
FIG. 5 is a view similar to FIG. 4, showing the ribs reversely bent downwardly by the guide plate.

When the rod 25 is pulled upwardly further, the collar presses the rib inner ends against the lower guide surface 24 of the plate 23 (see FIG. 5), causing the ribs to snap or reverse into the conventional umbrella position, i.e. curved radially downwardly and outwardly. Hence, the cloth folds over and covers the golf club heads and the open top of the bag. Should the golfer wish to continue playing or wish to remove or replace clubs, he can push the rod 25 down a short distance to cause the pressure of the rim 16 to reverse the flexible cloth-like cover back into the upwards position of FIG. 2. Thus, the golfer can rapidly extend the cover by pulling the grip up and momentarily remove the cover by pushing the rod downwardly without fully retracting the umbrella. Thus, the bag upper end can be quickly exposed or covered without disturbing the clubs in the bag.

The drawings illustrate one embodiment of this invention. The various parts may be modified in accordance with the claims appended hereto. Thus, it is desired that the foregoing description be read as illustrative of an operative embodiment of this invention and not in a strictly limited sense.

Having fully described an operative embodiment of this invention, I now claim:

1. A foldable golf bag umbrella comprising:

a normally vertically arranged, elongated, open upper end, outer tube adapted to fit within a golf bag along with the golf clubs, and clamp means for releasably securing the tube to the wall of the bag with the upper end of the tube opening above the upper end of the bag;

the upper end of the tube is formed as an upper edge rim;

a central guide tube arranged coaxially with, and extending along the length of the outer tube;

a disk fixed upon the upper end of the guide tube a short distance above said rim and generally overlapping the rim to form a space between the disk and rim;

an elongated rod coaxially, slidably extending through the disk and guide tube and within the outer tube, with the rod having an upper end portion extending above the disk;

a ring-like collar surrounding the guide tube and slidable upwardly and downwardly along the length of the guide tube, with the rod being connected to the collar so that upward and downward sliding movement of the rod correspondingly moves the collar upwardly and downwardly within the outer tube;

a number of elongated, resilient, normally curved umbrella ribs having inner ends pivotally connected to the collar and having free outer ends normally arranged adjacent the open upper end of the outer tube for radially outwards extension through said space, and with a flexible, cloth-like umbrella cover attached to and extending between the ribs;

said ribs being characterized by having an elastic memory so that they may be substantially flattened under pressure, but will return to their normal curved shape upon release of the pressure;

whereby the rod may be slid downwardly, through the disk and guide tube, deeply into the outer tube for moving the collar into close proximity with the bottom of the outer tube for thereby pulling the pivoted inner ends of the ribs downwardly into the tube for substantially flattening the ribs and locating the ribs and cover within the outer tube and around the guide tube to retract the umbrella, but the rod may be pulled upwardly so that the collar is moved to the outer tube rim and the ribs are guided outwardly of the outer tube and upwardly around the disk, and after the ribs are substantially fully extended, a further, short uwpard movement of the rod causes the collar to press the ribs against the underside of the disk to reverse the ribs so that they bend downwardly and outwardly into their curved shapes for opening the umbrella above the top of the outer tube and the top of the golf bag, and a short downward thrust of the rod causes the pressure of the rim against the ribs to reverse the ribs back into their upwardly and outwardly extending position.

2. A foldable golf bag umbrella as defined in claim 1, and including the upper end portion of the outer tube being radially outwardly flared so that the rim is of a greater diameter than the tube portion below the flared end, for guiding the free ends of the umbrella ribs upwardly and radially outwardly of the outer tube during their endwise movement out of the outer tube and radially inwardly of the outer tube during their endwise movement into the outer tube.

3. A foldable golf bag umbrella as defined in claim 1, and with the outer edge portion of the lower surface of the disk being sloped upwardly in a radially inwardly direction for forming a guide surface for forcing the ribs to bend radially outwardly and downwardly when the collar engages the lower surface of the disk after the ribs have moved outwardly of the outer tube over the rim of the outer tube and are extended generally upwardly and radially outwardly of the outer tube.

4. A foldable golf bag umbrella as defined in claim 3, and including a grip formed on the upper end portion of the rod for manually gripping the rod and for moving the rod endwise into and out of the outer tube to close and open the umbrella respectively.

5. A foldable golf bag umbrella as defined in claim 4, and said grip being generally of the shape and size of a conventional golf ball.

6. A foldable golf bag umbrella as defined in claim 1, and said collar being connected to the lower end portion of the rod through a vertically elongated slot formed in the guide tube by a connection member extending through said slot, with said member having an end connected to the rod and an opposite end connected to the collar.

7. A foldable golf bag umbrella as defined in claim 1, and including said clamp means being formed of a pair of inverted U-shaped springy clips which are sized and shaped to fit over and clamp the upper end portions of a golf bag;

with the outer tube arranged generally between the clips and radially inwardly of the clips relative to the axis of the golf bag, so that the outer tube is located in roughly axial alignment with the axis of the golf bag.

8. A foldable golf bag umbrella comprising:

a normally vertically arranged elongated outer tube having an open upper end terminating in an upper rim, with the outer tube adapted to fit within a golf bag, along with golf clubs, and including means for releasably fastening the outer tube to the wall of the golf bag adjacent the open upper portion of the bag;

a disk rigidly fixed above and axially aligned with the tube, with an annular space formed between the disk and tube upper rim;

an umbrella formed of a series of normally curved ribs having closely arranged inner ends and spaced apart outer ends, with the ribs being interconnected by a cloth-like umbrella cover, and with the umbrella arranged coaxially with the outer tube;

a collar normally arranged coaxially with, and within the tube for axial movement relative to the tube axis;

the rib inner ends being connected to the collar so that movement of the collar in a direction into the tube causes the ribs, along with the umbrella cover, to retract inwardly into the outer tube and to generally flatten due to their contact with the inner wall surface of the outer tube, and so that movement of the collar in a direction towards the tube rim causes the ribs to extend radially outwardly of said space for extending the ribs and the umbrella cover between the ribs upwardly and outwardly;

said ribs being characterized by being formed of a relatively stiff, but resilient plastic material which is characterized by having an elastic memory wherein the ribs may be substantially flattened under pressure, but will return to their curved shapes upon release of such pressure for holding the umbrella in open position;

and means for moving the collar axially within the outer tube in a direction closer to and further from said disk for extending and for retracting the umbrella, and including moving the collar close to the disk for pressing the ribs against the disk, after the ribs are substantially extended from the outer tube, to cause the ribs to reversely bend for extending downwardly and radially outwardly into an umbrella shape for covering over the golf bag.

9. A foldable golf bag umbrella, as defined in claim 8, and including the upper end portion of the outer tube being outwardly flared so that the rim is of a greater diameter than the remainder of the outer tube.

10. A foldable golf bag umbrella as defined in claim 8, and including the lower surface of the plate being tapered inwardly and upwardly to form a guide surface above the rim for guiding the ribs downwardly as the ribs are bent between the rim and the plate.

11. A foldable golf bag umbrella as defined in claim 10, and including manual means for moving the collar upwardly and downwardly within the outer tube.

12. A foldable golf bag umbrella as defined in claim 11, and including said manual means for moving the collar comprising an elongated rod slidably extending through the disk and into the outer tube, coaxially with the disk and outer tube, and having a lower end portion connected to the collar, and with the rod having an upper grip portion located above the disk for manually grasping and moving the rod upwardly and downwardly, and therefore, moving the attached collar, for extending and retracting the umbrella.

13. A flexible golf bag umbrella as defined in claim 12, and including guide means arranged within the outer tube for surrounding and guiding the axially directed movement of the rod.

* * * * *